US009067703B2

(12) United States Patent
Hewison

(10) Patent No.: US 9,067,703 B2
(45) Date of Patent: Jun. 30, 2015

(54) SELF-AERATING WINE BOTTLE

(75) Inventor: John A. Hewison, Shady Side, MD (US)

(73) Assignee: Airewire, LLC, Edgewater, MD (US)

( * ) Notice: Subject to any disclaimer, the term of this patent is extended or adjusted under 35 U.S.C. 154(b) by 255 days.

(21) Appl. No.: 13/191,657

(22) Filed: Jul. 27, 2011

(65) Prior Publication Data

US 2012/0031915 A1 Feb. 9, 2012

Related U.S. Application Data

(60) Provisional application No. 61/370,378, filed on Aug. 3, 2010.

(51) Int. Cl.
*B65D 23/04* (2006.01)
*B65D 1/02* (2006.01)

(52) U.S. Cl.
CPC ..... *B65D 1/0223* (2013.01); *Y10T 29/49826* (2015.01); *A47G 2400/045* (2013.01)

(58) Field of Classification Search
CPC ..... B65D 1/023; B65D 1/0223; B65D 23/04; B65D 2501/0009; B01F 3/0473; B01F 3/04099; A47G 2400/045
USPC ..... 95/260; 215/40, 43, 82, 382; 99/277.2, 99/323.1; 426/592
See application file for complete search history.

(56) References Cited

U.S. PATENT DOCUMENTS

| | | | | |
|---|---|---|---|---|
| 3,956,441 | A * | 5/1976 | Uhlig | 264/530 |
| D471,112 | S | 3/2003 | Davis et al. | |
| D538,170 | S | 3/2007 | Venkataraman et al. | |
| D563,230 | S | 3/2008 | Watts | |
| 8,333,287 | B2 * | 12/2012 | Lonsway et al. | 215/40 |
| 2003/0064807 | A1 * | 4/2003 | Walker et al. | 463/42 |
| 2003/0168372 | A1 * | 9/2003 | Headen et al. | 206/459.1 |
| 2006/0249518 | A1 * | 11/2006 | Festa | 220/669 |
| 2007/0125720 | A1 * | 6/2007 | Stecca | 210/781 |
| 2007/0267422 | A1 * | 11/2007 | Barducci | 220/608 |
| 2008/0290101 | A1 * | 11/2008 | Stecca | 220/703 |
| 2009/0084799 | A1 * | 4/2009 | Mondon | 220/674 |
| 2010/0248812 | A1 * | 9/2010 | Pacey et al. | 463/20 |
| 2010/0264107 | A1 | 10/2010 | Lonsway et al. | |

FOREIGN PATENT DOCUMENTS

| | | | |
|---|---|---|---|
| EP | 27780 | A1 * | 4/1981 |
| FR | 2788210 | A1 * | 7/2000 |
| WO | 2006099750 | A1 | 9/2006 |

OTHER PUBLICATIONS

International Search Report for related Application No. PDCT/US2011/045686.

* cited by examiner

*Primary Examiner* — Sue A Weaver

(74) *Attorney, Agent, or Firm* — Rosenberg, Klein & Lee

(57) ABSTRACT

The disclosed embodiments concern a self-aerating wine bottle. The self-aerating wine bottle may include a body having a top and a bottom, the top having an opening through which wine is dispensed, and a plurality of aerating shapes located in proximity to the top of the body, the plurality of aerating shapes serving to create a surface area that aerates wine when the wine is dispensed from the top of the body.

4 Claims, 3 Drawing Sheets

SELF-AERATING WINE BOTTLE

PRIORITY INFORMATION

This application claims priority from U.S. Provisional Patent Application Ser. No. 61/370,378, filed, Aug. 3, 2010, the content of which is incorporated herein by reference in its entirety.

BACKGROUND OF THE DISCLOSED EMBODIMENTS

1. Field of the Disclosed Embodiments

The disclosed embodiments relate to aeration of wine, and in particular, a self-aerating wine bottle.

2. Introduction

Wine bottles have remained essentially constant over the past 100-200 years. There are conventional wine aeration devices that attach to the top of a bottle. However, these devices are generally expensive and fragile. In addition, you must have the device with you to use it and that may be difficult and cumbersome if one is at restaurants or other places and consuming wine.

SUMMARY OF THE DISCLOSED EMBODIMENTS

The disclosed embodiments concern a self-aerating wine bottle. The self-aerating wine bottle may include a body having a top and a bottom, the top having an opening through which wine is dispensed, and a plurality of aerating shapes located in proximity to the top of the body, the plurality of aerating shapes serving to create a surface area that aerates wine when the wine is dispensed from the top of the body.

BRIEF DESCRIPTION OF THE DRAWINGS

In order to describe the manner in which the above-recited and other advantages and features of the disclosed embodiments can be obtained, a more particular description of the disclosed embodiments briefly described above will be rendered by reference to specific embodiments thereof which are illustrated in the appended drawings. Understanding that these drawings depict only typical embodiments of the disclosed embodiments and are not therefore to be considered to be limiting of its scope, the disclosed embodiments will be described and explained with additional specificity and detail through the use of the accompanying drawings in which.

DETAILED DESCRIPTION OF THE DISCLOSED EMBODIMENTS

Figure 1:
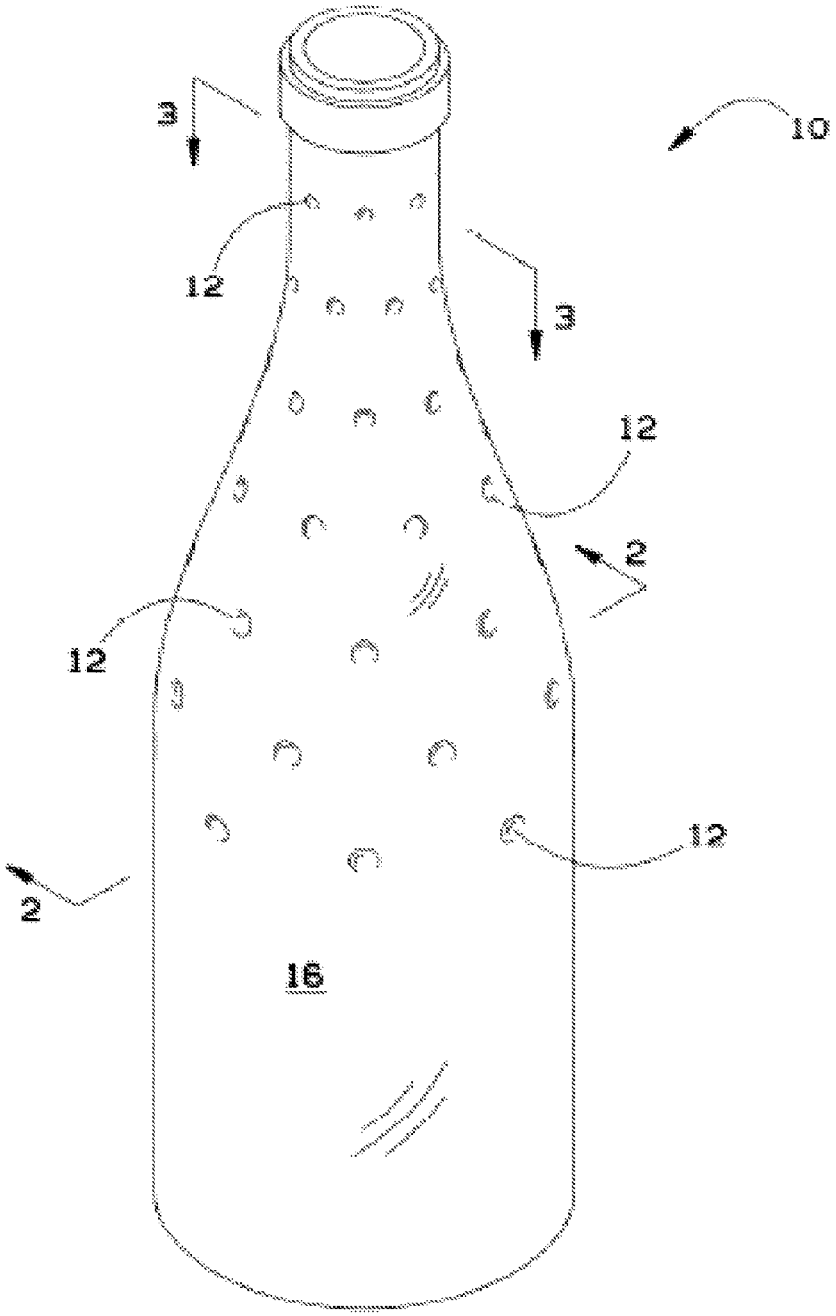
FIG. 1 is a perspective view of a self-aerating wine bottle in accordance with a possible embodiment.

Additional features and advantages of the disclosed embodiments will be set forth in the description which follows, and in part will be obvious from the description, or may be learned by practice of the disclosed embodiments. The features and advantages of the disclosed embodiments may be realized and obtained by means of the instruments and combinations particularly pointed out in the appended claims. These and other features of the disclosed embodiments will become more fully apparent from the following description and appended claims, or may be learned by the practice of the disclosed embodiments as set forth herein.

Various embodiments of the disclosed embodiments are discussed in detail below. While specific implementations are discussed, it should be understood that this is done for illustration purposes only. A person skilled in the relevant art will recognize that other components and configurations may be used without parting from the spirit and scope of the disclosed embodiments.

The disclosed embodiments comprise a variety of embodiments, such as an apparatus and method, and other embodiments that relate to the basic concepts of the disclosed embodiments.

The disclosed embodiments relate to a new way to self-aerate wine inside a bottle and create a unique bottle design that creates more surface area inside a wine bottle.

The bottles may be manufactured with aerating shapes, such as dimples, etc., which may be created in different patterns on the upper part of the wine bottle and part of the neck. Various varietals may use different aerating shapes, different sizes of inverted aerating shapes, and density patterns of aerating shapes. For example, a merlot varietal could use a different and greater density of aerating shapes than a Pinot Noir varietal. The same may be true of Cabernet Sauvignon and Zinfandel varietals. White wine varietals may use a less intense series of aerating shapes, for example.

One of the key elements of the disclosed embodiments is the exterior inverted (or everted) aerating shapes that are pressed into the wine container body (e.g., glass, plastic, etc.) from the outside (or inside) of the bottle during manufacturing. That process then changes the interior (or exterior) of the wine bottle, which in turn creates an aerating surface for the wine to travel over when it is poured.

The aerating shapes may be round, square, diamond, star-shaped, heart-shaped, etc. By creating aerating shapes in different shapes, sizes and forms to match various varietals, this process creates more surface area inside the bottle and the opportunity to aerate the wine in a completely novel way that has never been used before. When the wine is poured it must move over the aerating shapes to create a special lift and drop action which adds oxygen which in turn opens the wine to air and brings it to life. The self-aerating wine bottle improves over extra external equipment as the aerating shapes that are actually incorporated in a wine bottle eliminate a step and expense, and saves world resources by doing more with the same amount of raw materials. The disclosed embodiments use interior and exterior elements and functionality that change and enhances the taste of the wine in a way that has not been seen before in the wine world.

Thus, the disclosed embodiments solve the problem of not having to have extra accessories or equipment to aerate wine. Everything to aerate the wine is created within the wine bottle itself. The self-aerating wine bottle contains a series of aerating shapes that create a greater surface area for the wine. The aerating shapes may be created and pressed in from the outside of the wine bottle and when the wine is poured it runs over a series of aerating shapes causing the wine to aerate and open up to full flavor.

How the Self-Aerating Wine Bottle Benefits the Consumer

1: Consumer perceives the Self-Aerating Wine Bottle as added value.
2: Consumer has a truly new and unique wine experience.
3: Makes wine ready for drinking faster.
4: Aerates the wine inside the bottle when poured without any expensive attachments.
5: Makes for a memorable and unique gift (e.g., heart shaped aerating shapes).

How the Self-Aerating Wine Bottle Benefits a Wine Brand

1: Unique bottle design makes your brand stand out on the shelf and in the store.
2: Gets a buzz going about your brand.
3: Makes your brand stand out as cutting edge.
4: Creates in the consumer's mind a memorable value added experience about your brand.
5: Saves advertising dollars by consumer word of mouth and industry buzz.

How the Self-Aerating Wine Bottle Benefits the Retailer

1: Allows the retailer to talk up and explain the uniqueness of the Self-Aerating Wine Bottle's aerating shapes.
2: Unique selling proposition for retailers.
3: Customers are more likely to pick up a Self-Aerating Wine Bottle just for the feel. Studies show that a consumer is more likely to buy a bottle once he/she is holding it.
4: Allows the retailer to demonstrate the unique pour action of the Self-Aerating Wine Bottle.
5: Allows the retailer to create dare to compare comparisons tests inside the store.

How the Self-Aerating Wine Bottle Benefits the Bottle Maker

1: Create a unique bottle for the wine industry and charge a premium.
2: Use the same amount of glass and create more surface area inside the bottle.
3: Increase sales and broaden the manufacture's product lines.
4: No additional cost as everything is paid by the consumer.
5: Increase profits producing premium Self-Aerating Wine Bottles from the same amount of raw material.

FIG. 1 illustrates an exemplary self-aerating wine bottle 10 in accordance with a possible disclosed embodiment. The self-aerating wine bottle 10 may include a wine bottle body 16 and a plurality of aerating shapes 12, such as the dimples shown. The body 16 may have a top, a bottom, and a neck located near the top of the body 16. The top of the body 16 may have an opening to dispense wine that may be closed using a cork, a screw-top, glass stopper or any other wine-bottling closure. The self-aerating wine bottle 10 may be formed such that the bottom of the body 16 is larger than the top of the body 16.

A plurality of aerating shapes 12 may be located in proximity to the top of the body 16. The plurality of aerating shapes 12 may serve to create a surface area that aerates wine when the wine is dispensed from the top of the body 16.

The plurality of aerating shapes 12 may be inverted, everted (i.e., extend outward from the body 16), or a combination of inverted and everted. The plurality of aerating shapes 12 may be a single type or combination of types and may include crescents, stars, hearts, dimples, grooves, squares, circles, ovals, polygons, diamonds, lightning bolts, snowflakes, or any other type of shape as long as the shape creates a surface area that may aerate the wine.

The size of the plurality of aerating shapes 12 may depend on the type of wine contained inside the body 16. In addition, the shape of the plurality of aerating shapes 12 depends on the type of wine contained inside the body 16. Moreover, the density of the plurality of aerating shapes 12 may depend on the type of wine contained inside the body 16. For example, the wine varietal (or type) shiraz may have a different size, shape and/or density of aerating shapes 12 than pinot noir.

Figure 2:
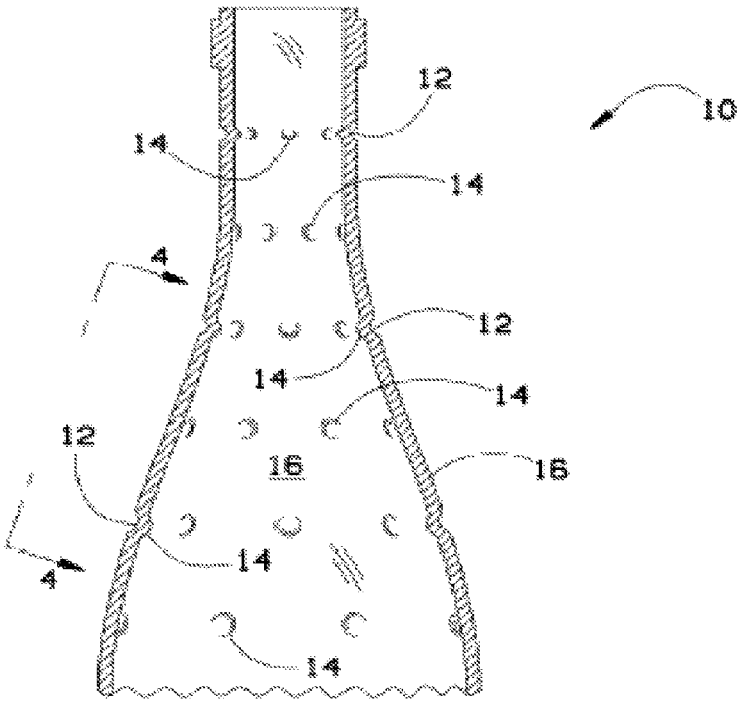
FIG. 2 is a partial section view of the self-aerating wine bottle taken along line 2-2 in FIG. 1 in accordance with a possible embodiment.
Figure 3:
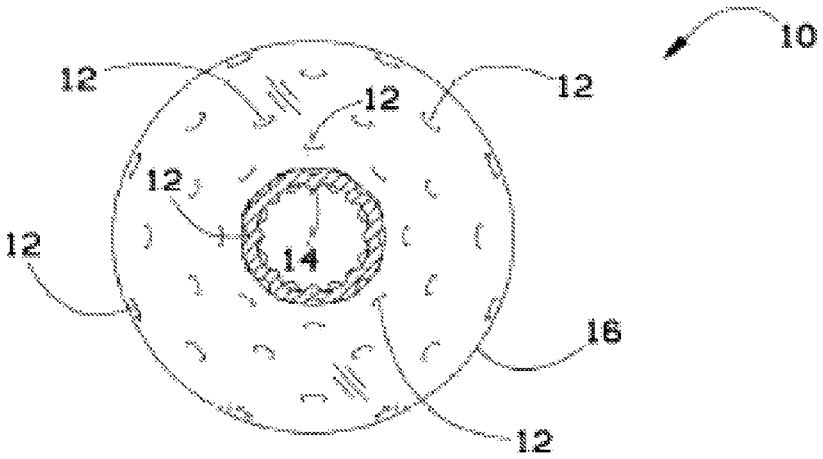
FIG. 3 is a section view of the self-aerating wine bottle taken along line 3-3 in FIG. 1 in accordance with a possible embodiment.

With regard to the location and coverage of the plurality of aerating shapes 12 on the body 16, the plurality of aerating shapes 12 may be in the range of 0.05-0.25 inches in depth, for example. The plurality of aerating shapes 12 may begin in the range 0.5-2 inches from the top of the body 16, for example. The plurality of aerating shapes 12 may cover an area from 0.5-7 inches from the top of the body 16, for example. However, the plurality of aerating shapes 12 may also cover the whole body 16 as a decorative and well as functional aerating aspect as discussed herein, for example FIG. 2 illustrates a side view of an exemplary self-aerating wine bottle 10 in accordance with a possible disclosed embodiment. FIG. 3 illustrates a top view of an exemplary self-aerating wine bottle 10 in accordance with a possible disclosed embodiment.

Figure 4:
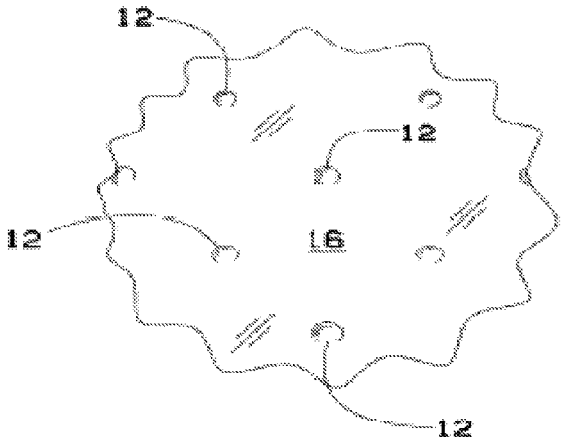
FIG. 4 is a detailed view of the dimples as aerating shapes taken along line 4-4 in FIG. 2 in accordance with a possible embodiment.
Figure 5:
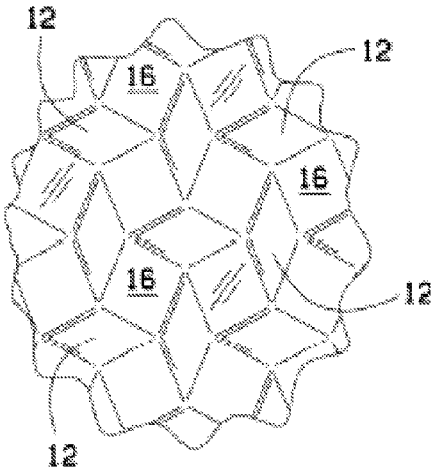
FIG. 5 is a detailed view of the large diamonds as aerating shapes in accordance with a possible embodiment.
Figure 6:
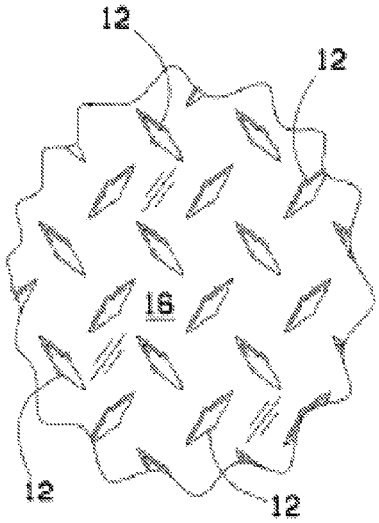
FIG. 6 is a detailed view of the small diamonds 12 as aerating shapes in accordance with a possible embodiment.

FIGS. 4-6 illustrate exemplary inverted aerating shapes 12 for the self-aerating wine bottle 10 in accordance with possible disclosed embodiments. FIG. 4 illustrates dimples as plurality of aerating shapes 12 for the body 16 of the self-aerating wine bottle 10. FIG. 5 illustrates large diamonds as plurality of aerating shapes 12 for the body 16 of the self-aerating wine bottle 10. FIG. 6 illustrates smaller diamonds as plurality of aerating shapes 12 for the body 16 of the self-aerating wine bottle 10.

While particular sizes and shapes are shown for the inverted aerating shapes 12 for the body 16 of the self-aerating wine bottle 10, these are merely examples. The aerating shapes may inverted, everted (i.e., protrude outward from the bottle) or a combination of inverted and everted aerating shapes.

The disclosed embodiments may also include a method of manufacturing a self-aerating wine bottle 10. The method may include forming a body 16 having a top and a bottom. The top includes an opening through which wine is dispensed. The method may also include forming a plurality of aerating shapes 12 located in proximity to the top of the body. The plurality of aerating shapes 12 serve to create a surface area that aerates wine when the wine is dispensed from the top of the body 16.

Although the above description may contain specific details, they should not be construed as limiting the claims in any way. Other configurations of the described embodiments of the disclosed embodiments are part of the scope of the disclosed embodiments. Accordingly, the appended claims and their legal equivalents should only define the disclosed embodiments, rather than any specific examples given.

I claim:

1. A self-aerating wine bottle, comprising:

a body having a top and a bottom, the top having an opening through which wine is dispensed; and a plurality of aerating shapes located in proximity to the top of the body, the plurality of aerating shapes being configured to create a greater surface area for wine to contact oxygenated air as the wine is poured from the bottle, the plurality of aerating shapes each extending toward an interior of the body from an exterior of the body, and defining a corresponding depression in the exterior of the body, the plurality of aerating shapes being located in an area extending a distance from the top of the body to a point that lies in a range of 0.5 inches to 2 inches from the top of the body whereby wine contained by the bottle is caused to contact air while wine is in the bottle and being poured from the bottle.

2. The self-aerating wine bottle of claim 1, wherein the plurality of aerating shapes are selected form the group consisting of crescents, stars, hearts, dimples, grooves, squares, circles, ovals, polygons, diamonds, and lightning bolts.

3. The self-aerating wine bottle of claim 1, wherein the aerating shapes are 0.05-0.25 inches in depth.

4. The self-aerating wine bottle of claim 1, wherein the aerating shapes cover an area from 0.5-7 inches from the top of the body.

* * * * *